US006074151A

United States Patent [19]

Pas

[11] Patent Number: 6,074,151

[45] Date of Patent: Jun. 13, 2000

[54] BINDING APPARATUS FOR PAPER FILES

[75] Inventor: David Pas, Antwerpen, Belgium

[73] Assignees: Esselte N.V., Sint-Niklaas, Belgium; Attalus High Tech Industry SA, Athens, Greece

[21] Appl. No.: 09/223,020

[22] Filed: Dec. 30, 1998

[30] Foreign Application Priority Data

Dec. 30, 1997 [EP] European Pat. Off. ..... 97 122 978

[51] Int. Cl.[7] ..... B42B 5/08

[52] U.S. Cl. ..... 412/38

[58] Field of Search ..... 412/38, 39, 40, 412/33; 402/1, 4; 83/549, 571

[56] References Cited

U.S. PATENT DOCUMENTS 3,699,596 10/1972 Lyon .
5,143,502 9/1992 Kaufmann et al. ..... 412/38 X
5,211,522 5/1993 Ho .
5,487,634 1/1996 Vercillo ..... 412/38 X
5,827,034 10/1998 Von Rohrscherdt ..... 412/38 X

*Primary Examiner*—Willmon Fridie, Jr.
*Attorney, Agent, or Firm*—Jones, Tullar & Cooper, P.C.

[57] ABSTRACT

The invention is directed to a binding apparatus for the binding of paper piles, comprising a punching unit for the punching of holes in a paper pile and a binding unit for the closing of a wire ring binder having a plurality of teeth which engage in the holes of the paper pile in a binding position. The punching unit comprises a movably arranged perforator plate having a plurality of punches and a counterplate that is rigidly connected to the housing of the binding apparatus and includes openings into which the punches engage in punching position, and the binding unit comprises of two clamping plates in an essentially parallel arrangement to each other.

21 Claims, 10 Drawing Sheets

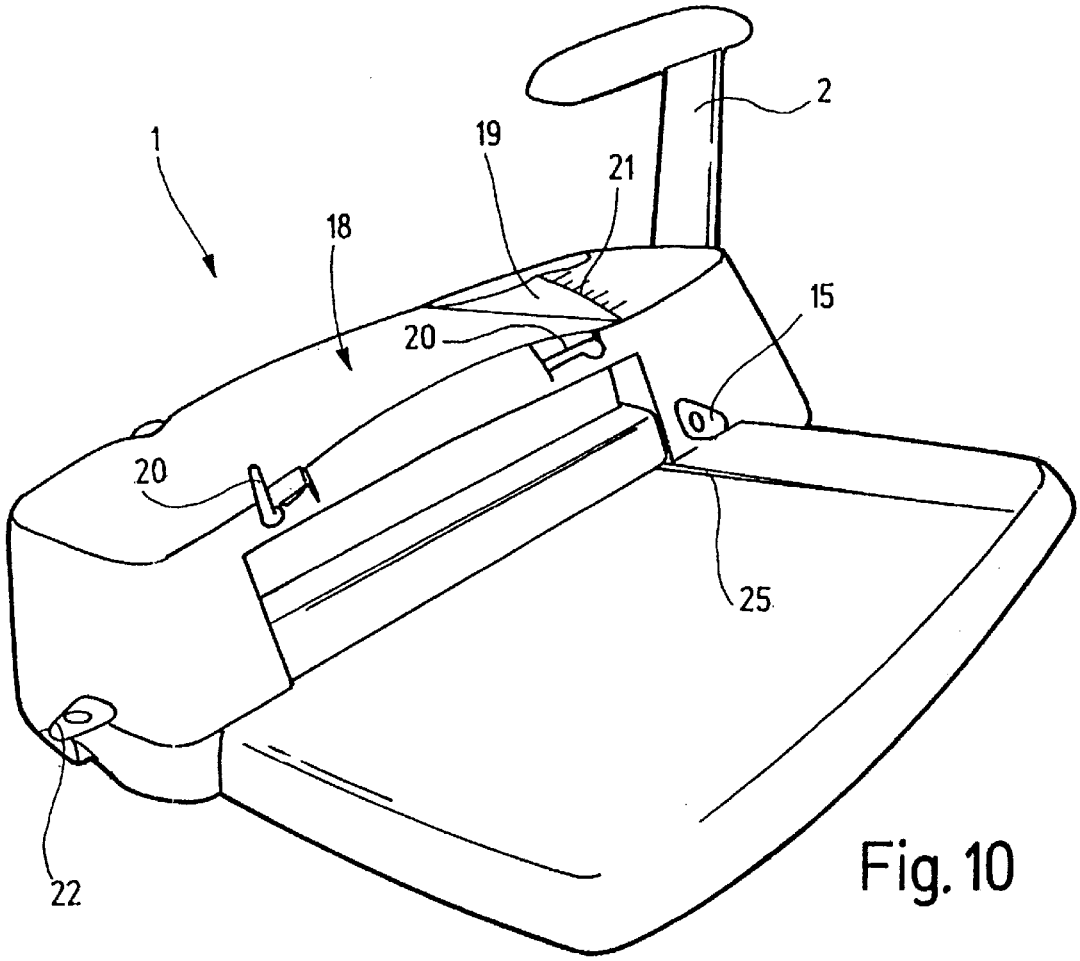
Fig. 10
Fig. 11
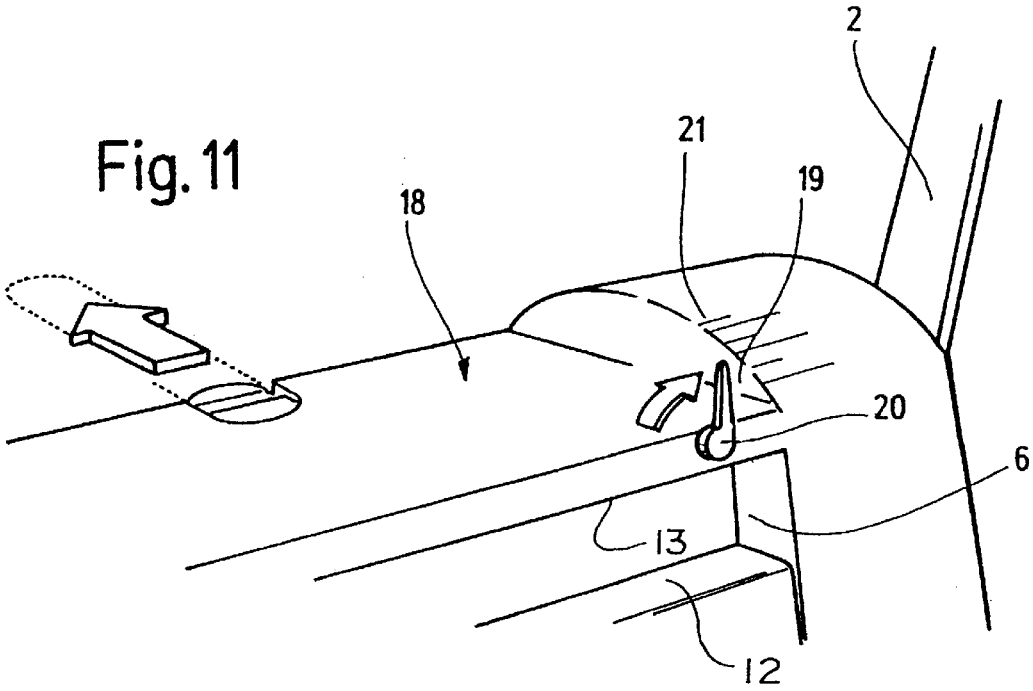

BINDING APPARATUS FOR PAPER FILES

This invention relates to a binding apparatus for the binding of documents, comprising a punching unit for the punching of holes in a paper pile consisting of several documents and a binding unit for the closing of a ring binder having a plurality of teeth which engage in the holes of the paper pile, the punching unit being composed of a movably arranged perforator plate having a plurality of punches and a counterplate that is rigidly connected to the housing of the binding apparatus and includes openings into which the punches engage in punching position, and the binding unit being comprised of two clamping plates in an essentially parallel arrangement to each other.

It is an object of the present invention to provide a binding apparatus of economical and reliable operation for wire ring binders.

This object is accomplished in that the first clamping plate is rigidly connected to the lower housing portion of the binding apparatus, the second clamping plate is rigidly connected to a perforator plate in an essentially vertical alignment to the punches, and an actuating element provided for actuating the punching unit and the binding unit.

According to an advantageous further feature of the binding apparatus of the present invention, the punches are either individual elements connected to the second clamping plate or a plate in which the individual punches have been punched out. The punches are designed furthermore to differ in length which is calculated in such a way that preferably a maximum of two punches punch the paper pile simultaneously. As a result of this configuration it is possible to reduce considerably the force exerted on the punching unit during the punching operation.

It has proven to be particularly advantageous for the lower edge of the punches to be of V-shape. Preferably, the punching zones of the punches are of a concave shape or a guillotine-type shape in longitudinal section.

An advantageous further embodiment of the binding apparatus of the present invention provides for a limiting element which can be used to fix the movement of the second clamping plate of the binding unit in the direction of the first rigidly arranged clamping plate depending on the diameter of the particular ring binder used. The limiting element preferably has individual steps in the direction of the second clamping plate or punches, whose height is coordinated with the punching position or with the various diameters of the ring binders. For positioning purposes the limiting element is arranged to be movable vertically to the movement of the clamping plate or punches.

Provision is also made for a fixing element which locks the limiting element in the desired position. This fixing element is, for example, a pin that engages in corresponding recesses in the side face of the limiting elements. Either it is held in the locked position by a snap-action mechanism or it is spring-mounted.

An advantageous embodiment of the binding apparatus of the present invention provides for an alignment unit on the top of the binding apparatus, which aligns the punched paper pile in a desired position. The alignment unit is at least one stop edge. Advantageously, however, one lateral stop edge and one rear stop edge are provided.

Alternatively the alignment unit has at least two pins on which the punched paper piles are placed in succession. It is possible furthermore for the pins to be pivotally mounted so that they can be embedded in the surface of the binding apparatus when they are not required.

An advantageous embodiment of the binding apparatus of the present invention proposes a thickness gauging device for determining the thickness of the paper pile to be bound and the diameter of the ring binder required to match. Provision is made for this thickness gauging device in the direct vicinity of the alignment unit so that the diameter of the ring binder required can be determined already when aligning the paper pile.

BRIEF DESCRIPTION OF THE DRAWINGS

The present invention will be described in more detail in the following with reference to the accompanying drawings, in which:

FIG. 10 is a perspective view of a second embodiment of the binding apparatus of the present invention;

FIG. 11 is a detail view of the embodiment of the binding apparatus of the present invention of FIG. 10;

DESCRIPTION OF THE PREFERRED EMBODIMENTS

Figure 1:
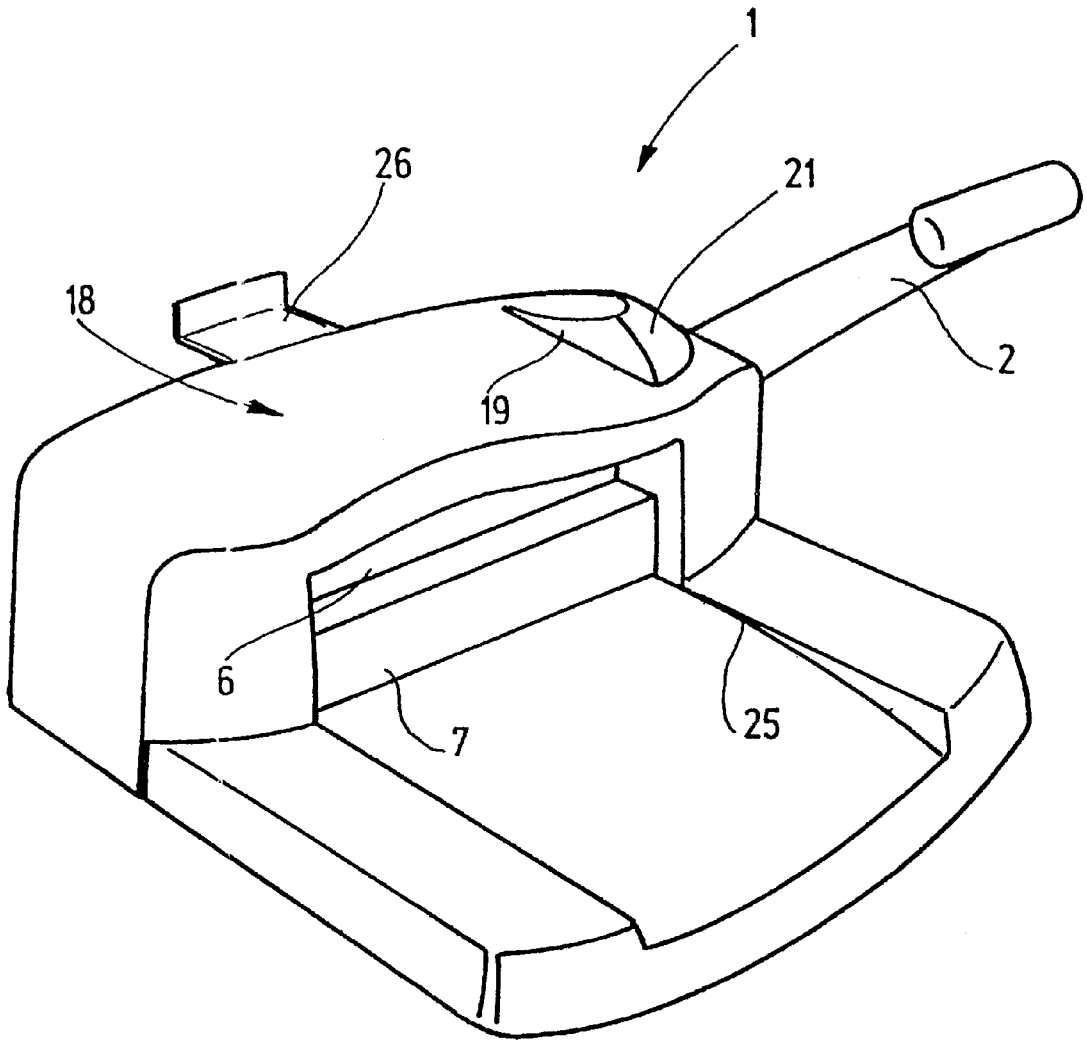
FIG. 1 is a perspective view of a first embodiment of the binding apparatus of the present invention.

FIG. 1 shows a perspective view of a first embodiment of the binding apparatus 1 of the present invention. In the lower part of the housing there are alignment edges 25 on both sides for the exact alignment of the unpunched paper pile 3 (FIGS. 13–15) during the punching operation (punching position).

The successively punched paper piles are positioned by means of the alignment unit 18 located on the top of the binding apparatus 1 in such a way that the holes 5 (FIGS. 13–15), which are punched successively in the individual paper piles 3, come to lie exactly one above the other. In the simplest case the stop edge 19 is enough for the alignment; it is possible, however, to improve the alignment considerably by providing a second stop edge 19 vertical to the first stop edge. In the case illustrated the function of this second stop edge 19 is performed by the projecting rear edge of the tray extension 26. The tray extension 26 is designed advantageously to be insertable in the housing of the binding apparatus 1 and is drawn out of the housing only when needed.

As mentioned in the foregoing, the purpose of aligning the successively punched paper piles 3 (the maximum punching capacity of the punching unit 7 is limited to a certain number of sheets) on the top of the binding apparatus 1 is to position the holes 5 of the paper piles 3 exactly one above the other. The teeth of the ring binder 4 (FIGS. 13 and 15) are then inserted in the holes 5; the ring binder 4 is positioned between the first and second clamping plate 12 and 13, respectively, of the binding unit 6 and is closed by actuating the actuating element 2.

To determine which diameter of ring binder 4 best matches the thickness of the paper pile 3 a thickness gauging device 21 is provided on the upper side of the binding apparatus 1 in the direct vicinity of the alignment unit 18. The arrangement is selected in such a way as to enable the thickness of the paper pile 3 or the diameter of the required ring binder 4 to be read directly off a scale on the top of the binding apparatus 1 during alignment of the paper pile 3. This direct relationship between the alignment unit 18 and the thickness gauging device 21 can be seen in detail in FIG. 14. Of course neither the alignment unit 18 nor the thickness gauging device 21 is restricted in its design to the embodiment illustrated in FIG. 14.

Figure 2:
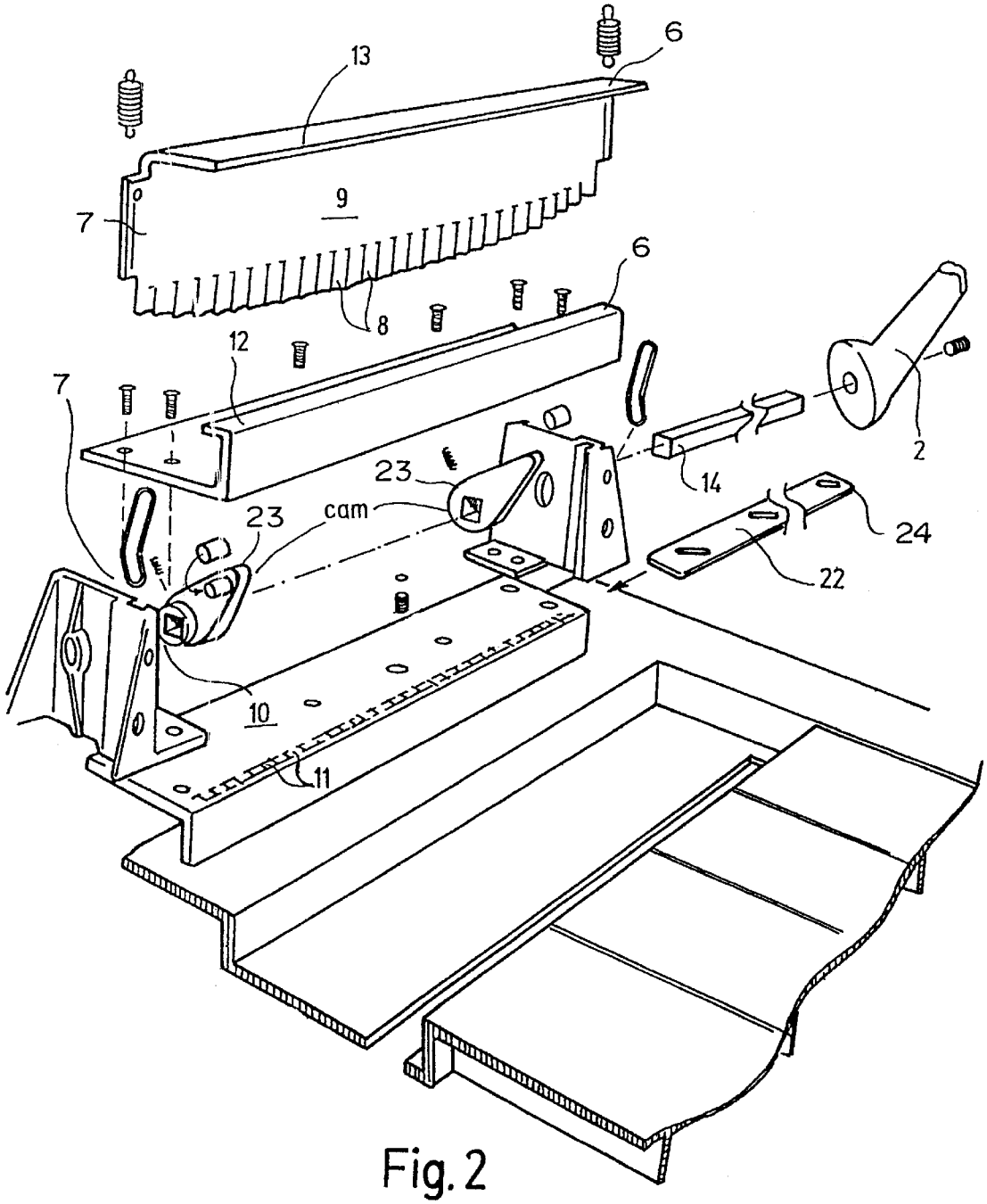
FIG. 2 is an exploded view of an embodiment of the binding apparatus of the present invention.
Figure 3:
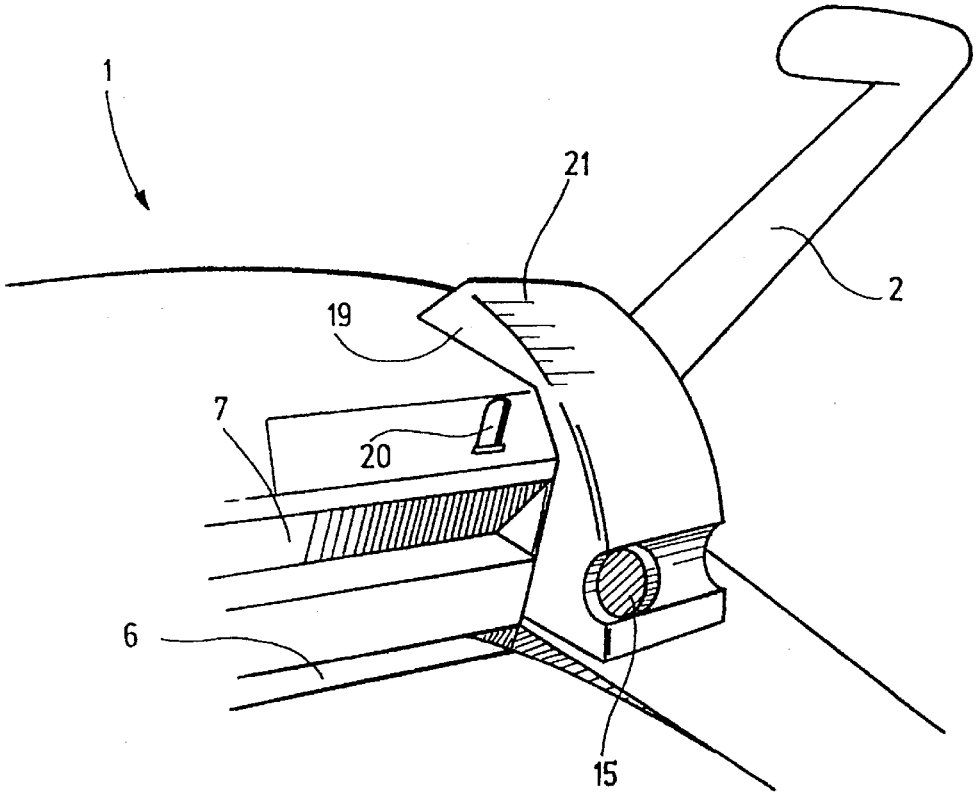
FIG. 3 is a perspective partial view of the binding apparatus of the present invention with an integrally formed limiting element.

FIG. 2 shows an exploded view of an embodiment of the binding apparatus 1 of the present invention. The punching unit 7 consists of a perforator plate 9 with individual punches 8 and a counterplate 10 which is rigidly connected to the lower housing portion of the binding apparatus 1. The counterplate 10 has openings which register with the punches 8 and which, for one purpose, fix the punches 8 in the correct position during punching and, for another purpose, hold down the punched paper pile 3 when the perforator plate 9 is moved upwards. The binding unit 6 comprises a first clamping plate 12 which is rigidly connected to the lower housing portion of the binding apparatus 1, and a second clamping plate 13 which is an integral part of the perforator plate 9 and is aligned in an essentially vertical arrangement to the punches 8.

The upward and downward movement of the perforator plate 9 and the second clamping plate 13 is performed generally by way of the actuating element 2. In the case illustrated, the actuating element 2 is a lever; in an electric version the latter could be replaced, of course, by a motor. The rotary movement of the lever is translated by the cam control device 23 into a translatory downward or upward movement depending on the particular direction of rotation.

Figure 9:
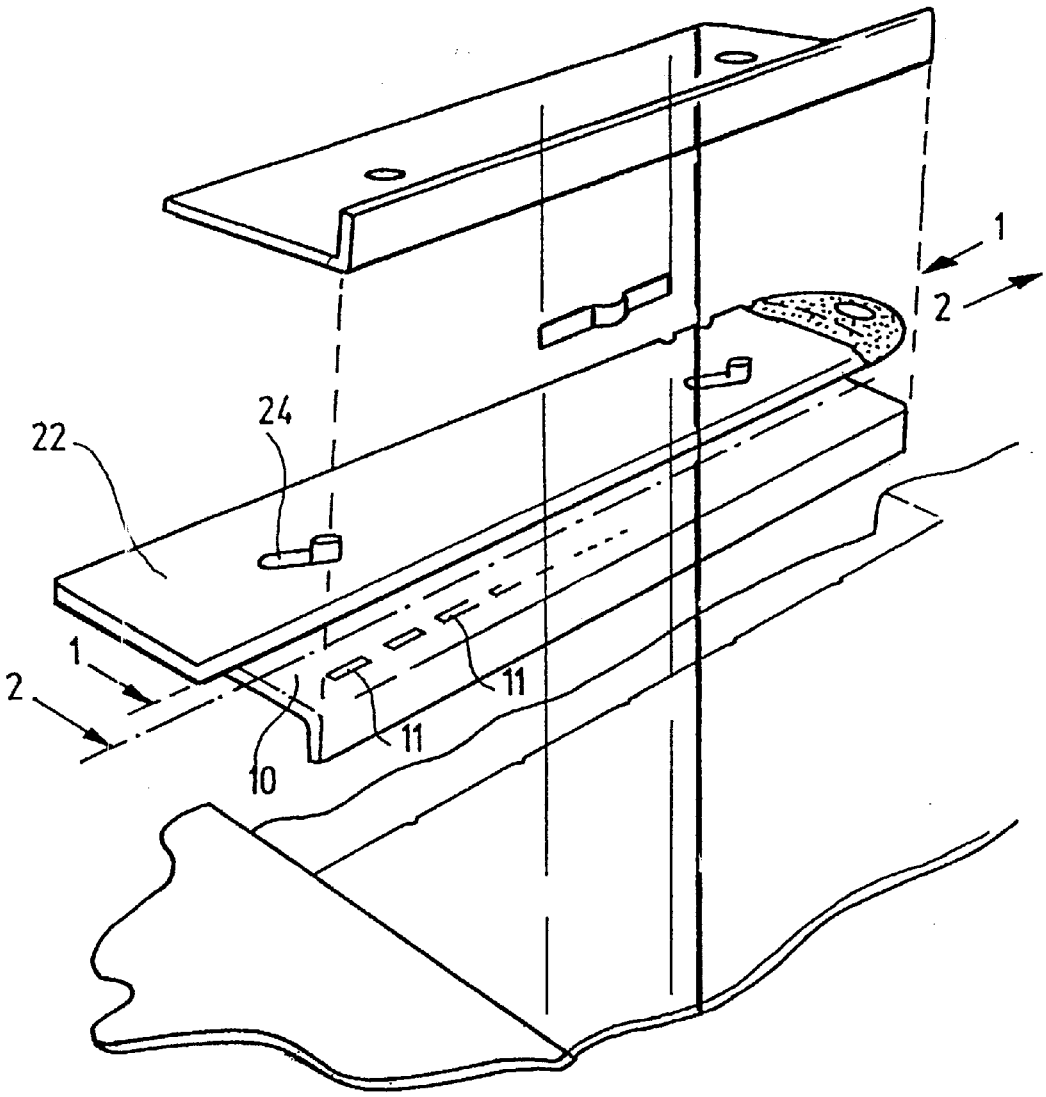
FIG. 9 is an exploded view of the positioning device for the rear edge of the paper pile in the punching position.

On the binding apparatus 1 illustrated in FIG. 2 provision is also made for a positioning device 22 for the rear edge of the paper pile 3. The positioning device 22 is comprised of a rectangular piece with—in the case illustrated—three diagonally arranged slots 24. When the positioning device 22 is moved to the side of the binding apparatus 1, the depth of its position relative to the binding apparatus 1 changes automatically. Hence the holes 5 are punched at varying distances from the rear edge of the paper pile 3 depending on the setting of the positioning device 22. The positioning device 22 is illustrated once again in greater detail in FIG. 9.

Figure 4:
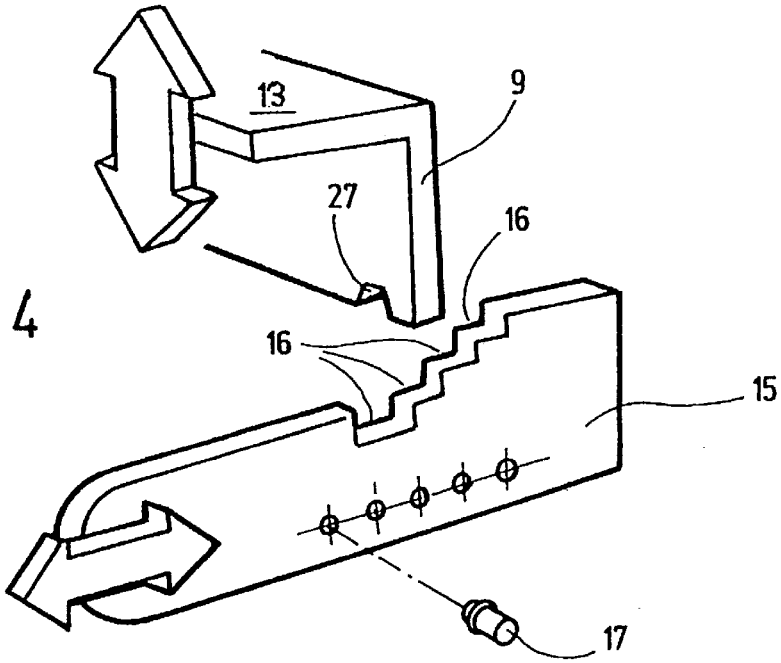
FIG. 4 is a perspective view of the limiting element.

As previously mentioned, both the binding unit 6 and the punching unit 7 are actuated by way of the lever 2. To punch the holes 5 in the paper pile 3 it is necessary to utilize the complete travel available so that the perforator plate 9 is moved from its topmost to bottommost position. To close the ring binder 4 it has to be possible to select the maximum travel of the second clamping plate 13 in relation to the first clamping plate 12 depending on the diameter of the ring binder 4 and the thickness of the paper pile 3 in order to achieve an optimum binding result. The limiting element 15, which can be seen in a perspective view in FIG. 4, serves this purpose.

The limiting element 15 is a plate standing on edge and having a plurality of steps 16 in the area of its top edge. The limiting element 15 is located in the lateral area of the binding apparatus 1 of the present invention. In the punching position the recess 27 on the bottom edge of the perforator plate 9 interacts with the lowest step 16 of the limiting element 15. The size of this lowest step is calculated so that the travel of the perforator plate 9 in punching position is not restricted by the limiting element 15. But as soon as the limiting element 15 is drawn forward out of the binding apparatus 1, the recess 27 in the perforator plate 9 interacts with one of the higher placed steps 16 of the limiting element 15. Hence in the binding positions defined by the various steps the second clamping plate 13 connected to the perforator plate 9 is moved only to within a defined distance of the first clamping plate 12. The defined distance is coordinated with the diameter of the ring binder 4 required in the particular case.

Figure 5:
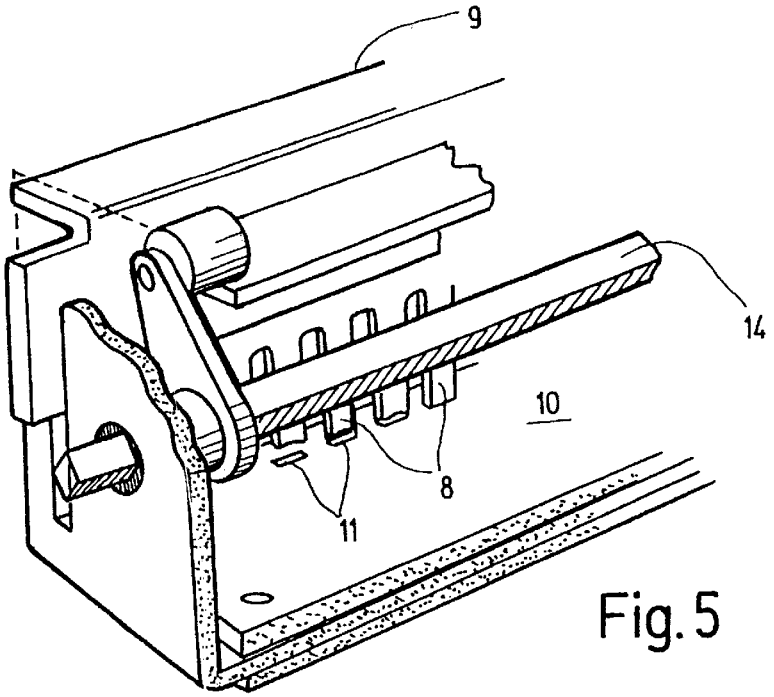
FIG. 5 is a perspective partial view of the punching unit.

The previously described punching unit 7 is shown once again in FIG. 5 in a perspective partial view.

Figure 6:
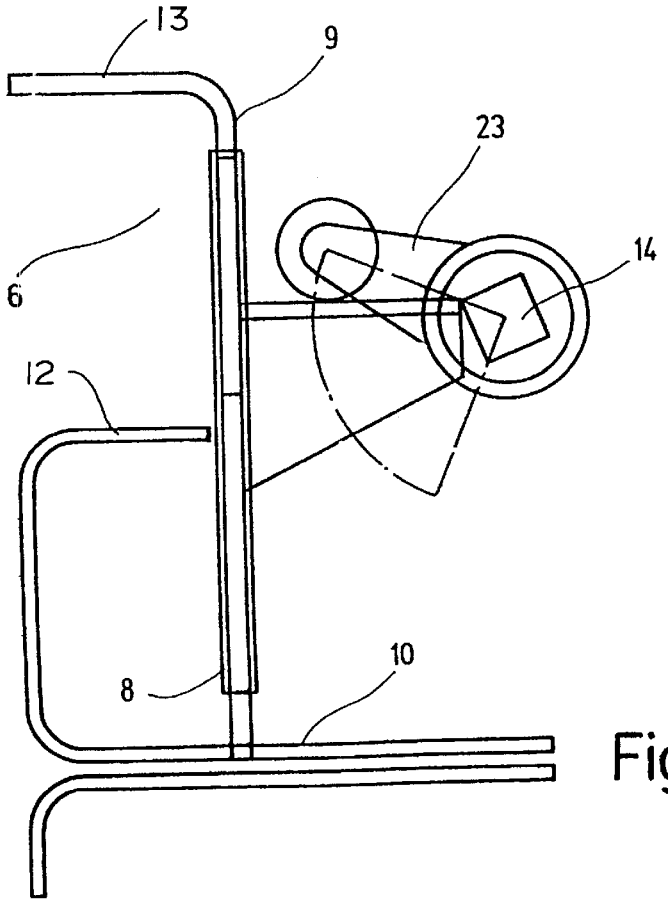
FIG. 6 is a cross-sectional view of the binding apparatus of the present invention.

FIG. 6 shows a cross section of the binding apparatus 1 of the present invention. As was previously mentioned, the punching unit 7 is comprised of a perforator plate 9 and a counterplate 10 that has openings 11 in the area of the punches 8 through which the punches 8 are guided. Either individual punches 8 are fitted to the perforator plate 9 or the punches 8 form an integral part of the perforator plate 9 in that they are punched out of it.

The binding unit 6 is comprised of a second clamping plate 13, which is an integral part of the perforator plate 9, and a first clamping plate which is rigidly connected to the housing of the binding apparatus 1. The upward and downward movement of the second clamping plate 13 and the perforator plate 9 is performed by way of the actuating element 2, not shown in the drawing, which is mounted on the rotary axle 14.

Figure 7:
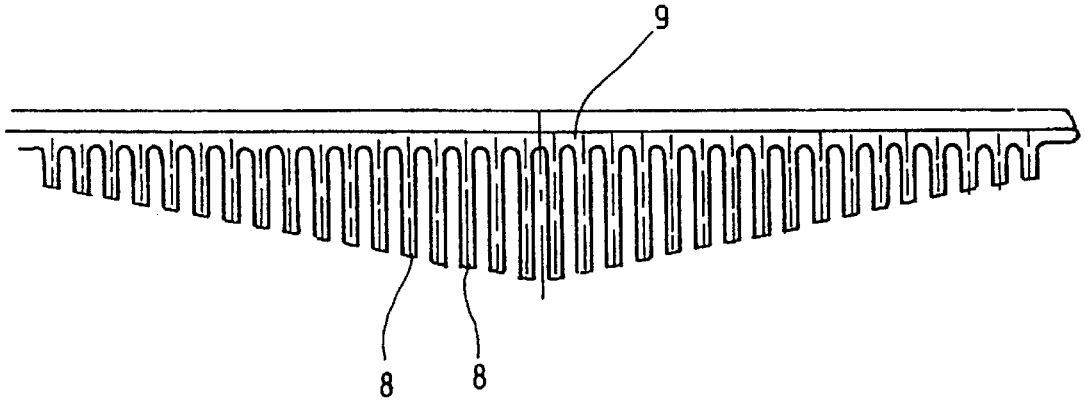
FIG. 7 is a top view of a first embodiment of the perforator plate.

FIG. 7 shows a top view of a first embodiment of the perforator plate 9, in which the individual punches 8 are punched out of a plate. The lower edges of the punches 8 are of an essentially V-shaped configuration. The difference in length between two adjacent punches 8 is calculated so that it corresponds to the maximum possible thickness of the paper pile 3 that can be punched in one punching operation. This configuration ensures that a maximum of two punches 8 punch the paper pile 3 simultaneously, whereby the force exerted on the punching unit 7 during the punching operation is correspondingly low. Conversely this means that the distance traveled by the perforator plate 9 during a punching operation has to be coordinated with the aggregate difference in length between the punches 8 of one half of the perforator plate 9.

Figure 8:
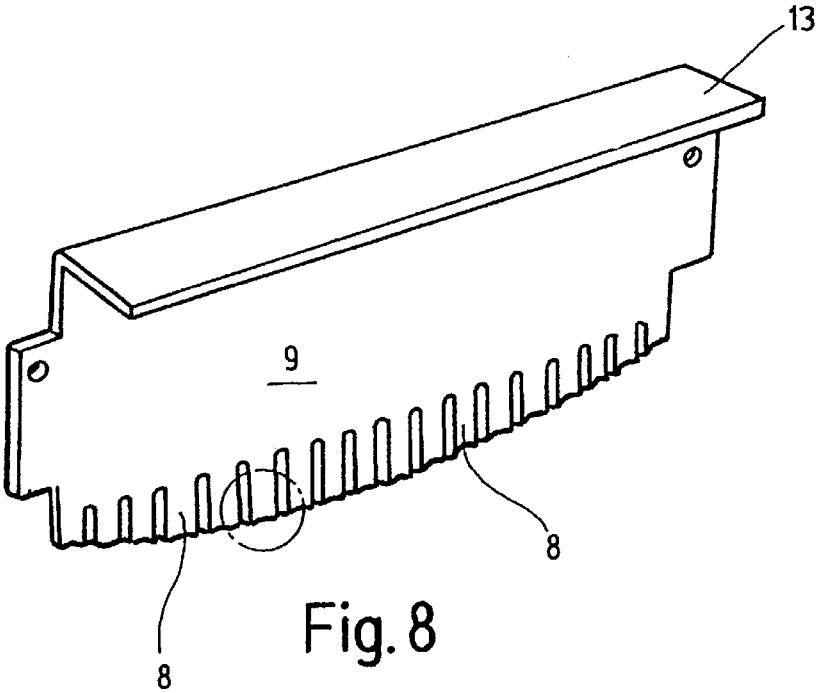
FIG. 8 is a top view of a second embodiment of the perforator plate.

FIG. 8 shows a top view of a second embodiment of the perforator plate 9, on which the bottom edges of the punches 8 of the perforator plate 9 are curved in a convex fashion. This configuration ensures similarly that the punches 8 do not strike and punch the paper pile 3 simultaneously but successively. Once again it is possible for the difference in length between two adjacent punches to comply with the condition already mentioned in connection with FIG. 7.

Further embodiments of the perforator plate 9 are also conceivable. For example, it is possible for the length of the punches 8 to decrease continuously from one side of the perforator plate 9 to the other. In this case the difference in length could be selected particularly in such a way that only one punch 8 punches the paper pile 3 at a time. Doubling the travel of the perforator plate 9 would consequently halve the force required to punch the holes 5.

It is possible likewise for the lower edges of the individual punches 8 to have various shapes. Such shapes may include a concave or a guillotine-type configuration (in a longitudinal direction and in a direction normal thereto).

Several embodiments of an alignment unit 18 on the binding apparatus 1 of the present invention are shown in a perspective view in FIGS. 10 to 14 and in FIG. 1. In FIG. 1 the alignment unit comprises a lateral stop edge 19 and a rear stop edge, whereas in FIG. 10 and FIG. 11 two pins 20 positioned in the outer areas of the alignment unit 18 are used for alignment and fixing of the punched paper piles 3. The two pins 20 are rotated up when required, and the paper piles 3 are placed with their corresponding holes 5 on the pins 20. The tray extension 26 is provided to enlarge the tray surface on the binding apparatus 1 as necessary.

When all the paper piles 3 needed to form the final bound product have been punched and placed on the pins 20, the thickness of the paper pile 3 or the diameter of the required ring binder 4 is read off the thickness gauging device 21. The teeth of the ring binder 4 are inserted in the holes 5 of the paper pile 3 from above. The limiting element 15 is set in accordance with the ring binder 4 being used, meaning in the case illustrated that the limiting element 15 is drawn out of the housing of the binding apparatus 1 up to the position corresponding to the diameter of the selected ring binder 4. The ring binder 4 with the paper pile 3 is then inserted in the binding unit 6 and is closed as far as the required position set on the limiting element 15 by actuating the lever 2.

Figure 12:
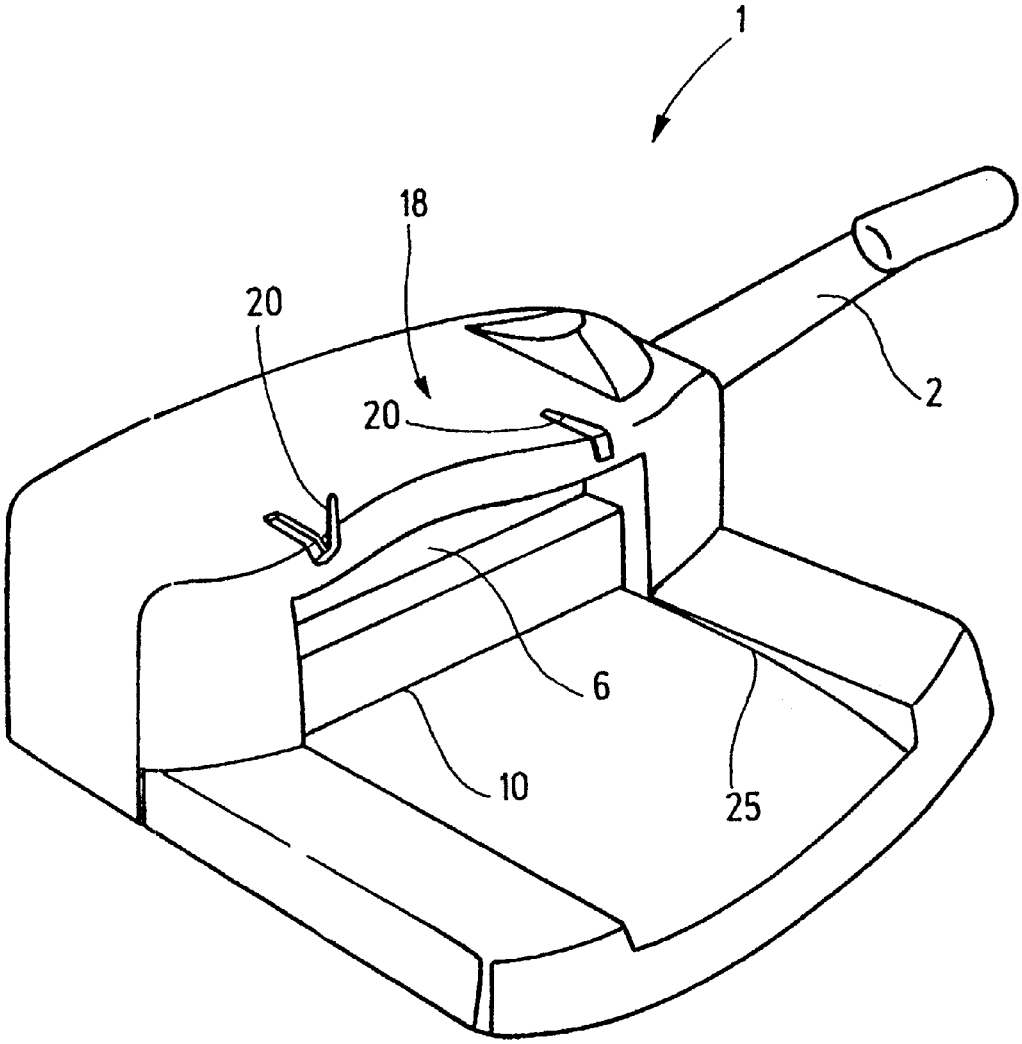
FIG. 12 is a perspective view of a third embodiment of the binding apparatus of the present invention.

The perspective view of a third embodiment of the binding apparatus 1 of the present invention shown in FIG. 12 has the advantage of enabling the pivotally constructed pins 20 to be embedded in matching recesses 28 in the surface of the housing of the binding apparatus 1 when they are not in use. The recesses 28 are preferably constructed so that the pins 20 are flush with the surface of the binding apparatus 1 when they are folded in.

Figure 13:
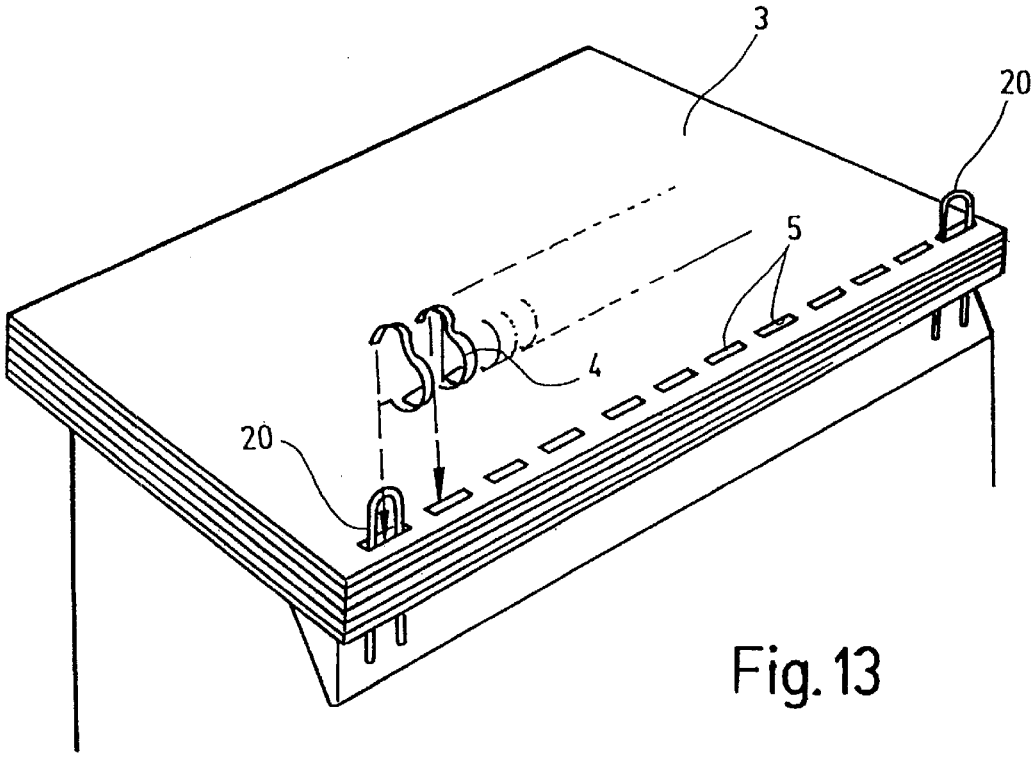
FIG. 13 is a top view of the alignment unit according to a fourth embodiment of the binding apparatus of the present invention.
Figure 14:
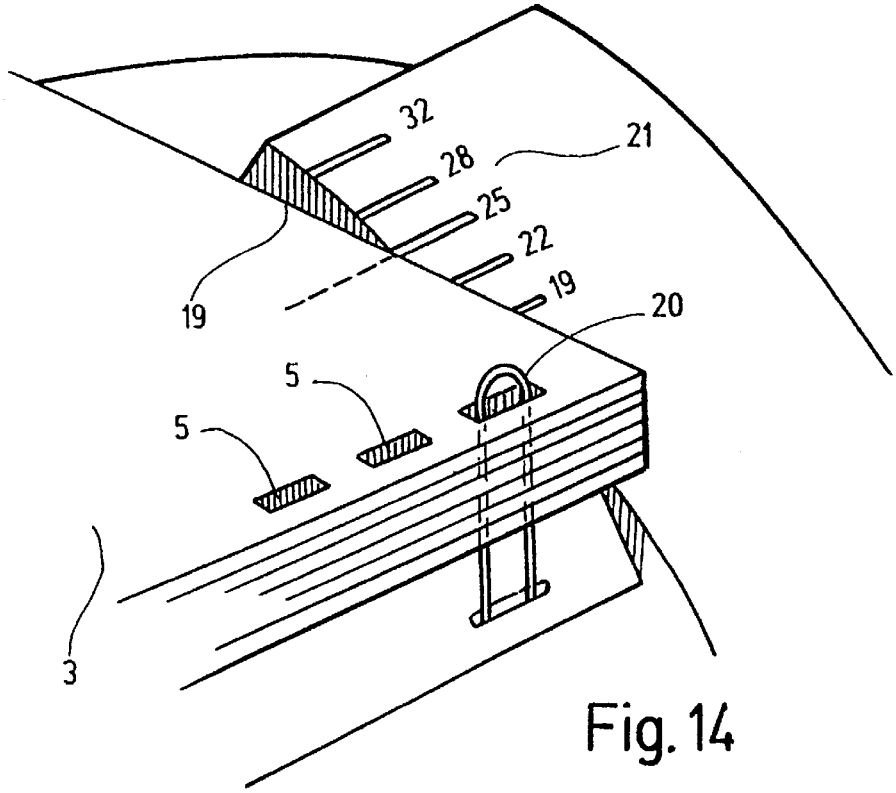
FIG. 14 is a detail view of an embodiment of the thickness gauging device for the binding apparatus of the present invention.

FIGS. 13 and 14 are top views of a fourth embodiment of the alignment unit 18. According to this embodiment the pins 20 are of curved shape and can also be pushed into the housing of the binding apparatus 1 when not in use. FIG. 13 also illustrates how to insert the ring binder 4 in the holes 5 of the paper pile 3 in accordance with the invention.

Figure 15:
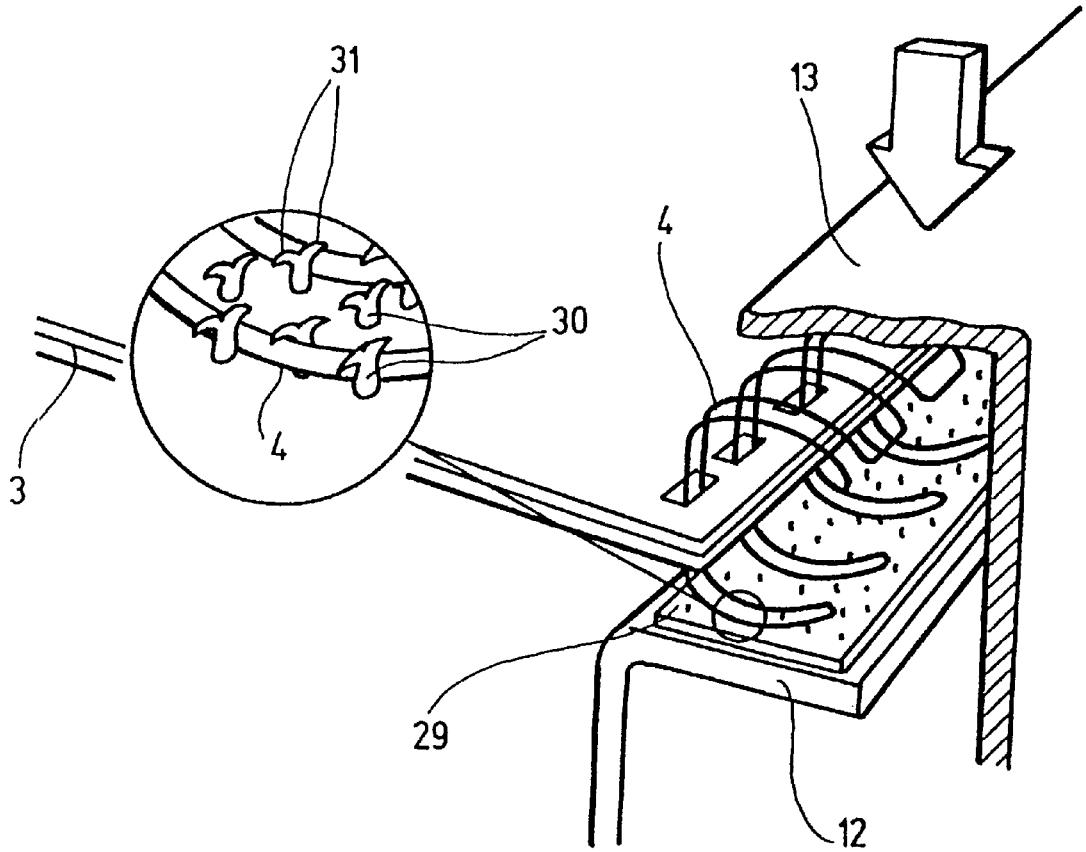
FIG. 15 is a perspective view of an embodiment of the binding unit.

FIG. 15 illustrates in perspective view a preferred embodiment of the binding unit 6. To ensure that the ring binder 4 with the paper pile 3 inserted is maintained in the desired position during binding and is not moved forwardly out of the space between the two clamping plates 12, 13, the upper side of the first clamping plate 12 is roughened. In the embodiment shown, a fastening material 29 in the form of a strip 29 (Velcro strip) is attached to the upper side of the first clamping plate 12, a simple configuration providing for the fastening material to be adhesively bonded to the upper side of the first clamping plate 12. The strong interaction between the ring binder 4 and the rough, yielding surface of the fastening material 29 effectively prevents the ring binder 4 from slipping out of its location during the binding operation. Obviously, this way of locating the ring binder 4 in position presents a highly economical solution. The detail illustration in FIG. 15 shows the property of the surface of the fastening material 29; it comprises tiny bristles 30 with barbs 31.

Locating the ring binder 4 in position between the first and the second clamping plate 12, 13 of the binding unit 6 can be further improved by arranging at least one of the two clamping plates 12, 13 at an inclination relative to the horizontal. This arrangement likewise prevents the ring binder 4 from being moved forwardly out of the space between the two clamping plates 12, 13 during binding.

I claim:

1. A binding apparatus for the binding of documents comprising a paper pile and a ring binder with teeth which engage in holes provided in the paper pile, comprising:

a housing including a lower housing portion;

a punching unit mounted to said housing for punching the holes in the paper pile;

a binding unit mounted to said housing for closing the ring binder in the holes of the paper pile to form the document; and an actuating element mounted to said housing for actuating both said punching unit and said binding unit, wherein:

said punching unit includes a movable perforator plate having a plurality of punches, and a counterplate rigidly connected to said lower housing portion, said counterplate having openings engaged by said punches, and said binding unit includes a first and second generally parallel clamping plates, with said first clamping plate being rigidly connected to said lower housing portion, and with said second clamping plate being rigidly connected to said punches in an essential vertical alignment to said punches.

2. The binding apparatus as defined in claim 1, wherein said punches comprise individual elements connected to said second clamping plate.

3. The binding apparatus as defined in claim 1, wherein said punches are formed as punched out elements of a said movable perforator plate.

4. The binding apparatus as defined in claim 1, wherein said punches differ in length such that a maximum of two punches punch the paper pile simultaneously.

5. The binding apparatus as defined in claim 3, wherein said punches define a V-shape at their ends.

6. The binding apparatus as defined in claim 3, wherein said punches are bent in a convex configuration.

7. The binding apparatus as defined in claim 3, wherein each punch defines a punching zone of concave shape.

8. The binding apparatus as defined in claim 7, wherein each punch defines a punching zone formed as a guillotine in longitudinal section.

9. The binding apparatus as defined in claim 1, further comprising:

a limiting element for fixing the movement of said second clamping plate in the direction of said first clamping plate as a function of the diameter of the particular ring binder.

10. The binding apparatus as defined in claim 9, wherein said limiting element includes individual steps in the direction of said second clamping plate, said steps being coordinated with the punching position of said punches and the various diameters of the wire ring binders, and wherein said limiting element is moved vertically relative to the movement of one of said perforator plate, said second clamping plate and said punches.

11. The binding apparatus as defined in claim 10, further comprising:

a fixing element for retaining said limiting element in a desired position.

12. The binding apparatus as defined in claim 1, further comprising:

an alignment unit on the top of said housing which aligns the punched paper pile in a desired position.

13. The binding apparatus as defined in claim 12, wherein said alignment unit includes at least one stop edge.

14. The binding apparatus as defined in claim 12, wherein said alignment unit includes at least two pins on which the punched paper piles are placed in succession.

15. The binding apparatus as defined in claim 14, further comprising:

recesses provided in the upper surface of said movable perforator plate, wherein said pins are pivotably mounted and correspond to said recesses which they engage.

16. The binding apparatus as defined in claim 12, further comprising:

a thickness gauging device for the paper pile to be bound is provided in the vicinity of said alignment unit, and wherein the ring binder is to be used is selected as a function of the thickness measured.

17. The binding apparatus as defined in claim 1, further comprising:

a positioning device provided for the rear edge of the paper pile.

18. The binding apparatus as defined in claim 1, further comprising:

a fastening material affixed to at least one of said first and second clamping plates.

19. The binding apparatus as defined in claim 18, wherein said fastening material is affixed to said first clamping plate.

20. The binding apparatus as defined in claim 18, wherein said fastening material is employed in strip form and is affixed to at least one of said first and second clamping plates by adhesive bonding.

21. The binding apparatus as defined in claim 1, wherein at least one of said first and second clamping plates is arranged at an inclination relative to the horizontal.

* * * * *